US006312075B1

(12) United States Patent
Walker

(10) Patent No.: US 6,312,075 B1
(45) Date of Patent: Nov. 6, 2001

(54) PRINT MEDIA FEEDBACK INK LEVEL DETECTION

(75) Inventor: Steven H. Walker, Camas, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/502,172

(22) Filed: Feb. 11, 2000

(51) Int. Cl.[7] ..... B41J 2/195

(52) U.S. Cl. ..... 347/7; 347/19

(58) Field of Search ..... 347/7, 19; 399/15, 399/24, 27, 30

(56) References Cited

U.S. PATENT DOCUMENTS 5,689,289 * 11/1997 Watanabe et al. ..... 347/7
5,798,771 * 8/1998 Nishii et al. ..... 347/7

* cited by examiner

*Primary Examiner*—Craig A. Hallacher

(57) ABSTRACT

A method and apparatus for determining ink supply depletion as a function of optical reflectance testing uses a given relationship of optical reflectance level data to the ink usage by percentage of prints made. At anytime during pen life, a test pattern can be printed and optically sampled to determine current reflectance level data. Use of an average current reflectance level from a given printhead can be entered into a polynomial equation representative of the relationship and the equation solved to provide a percentage of ink consumed to date.

15 Claims, 7 Drawing Sheets

PRINT MEDIA FEEDBACK INK LEVEL DETECTION

BACKGROUND OF THE INVENTION

1. Field of the Invention

The present invention relates generally to ink-jet hard copy methods and apparatus and, in particular, to the use of an optical sensor to monitor drop deposition characteristics which can be related to ink depletion in pen.

2. Description of Related Art

The art of ink-jet technology is relatively well developed. Commercial products such as computer printers, graphics plotters, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988).

FIG. 1 depicts an ink-jet hard copy apparatus, in this exemplary embodiment a computer peripheral printer, 101. For convenience in describing the art and the present invention, all types of ink-jet hard copy apparatus are hereinafter referred to as "printers," all types, sizes, and compositions of print media are also referred to as "paper," and all compositions of colorants are referred to as "ink;" no limitation on the scope of the invention is intended nor should any be implied.

A housing 103 encloses the electrical and mechanical operating mechanisms of the printer 101. Operation is administrated by an electronic controller (usually a microprocessor or application specific integrated circuit ("ASIC") controlled printed circuit board) 102 connected by appropriate cabling to a computer (not shown). It is well known to program and execute imaging, printing, print media handling, control functions and logic with firmware or software instructions for conventional or general purpose microprocessors or with ASIC's. Cut-sheet print media 105, loaded by the end-user onto an input tray 120, is fed by a suitable paper-path transport mechanism (not shown) to an internal printing station, or "print zone," 123 where graphical images or alphanumeric text are rendered onto adjacently positioned paper. A carriage 109, mounted on a slider 111, scans the print zone 123 (stationary paper wide ink-jet writing instruments are also known in the art and may be employed with the present invention). An encoder system 113 is provided for keeping track of the position of the carriage 109 at any given time. Individual ink-jet pens 115X are mounted in the carriage 109. Reusable printhead systems are fluidically coupled by tubing 119 to replaceable or refillable ink reservoirs 117X (generally, in a full color system, inks for the subtractive primary colors, cyan (X=C), yellow (X=Y), magenta (X=M) and true black (X=K) are provided; ink fixer (X=F) solutions are also sometimes provided). Each pen 115X operates using an internal back pressure regulator for allowing transfer of ink from a respective reservoir 117X while maintaining the appropriate back-pressure needed for the operation of each printhead of each pen. Note, it is also known in the art to provide replaceable ink jet cartridges which have a self-contained ink reservoir and back-pressure regulating mechanism. Once a printed page is completed, the print medium is ejected onto an output tray 121. As indicated by the labeled arrows, the scanning axis is referred to as the "x-axis," the paper transport path as the "y-axis," and the printhead firing direction as the "z-axis."

A simplistic schematic of a swath-scanning ink-jet pen 115X is shown in FIG. 2 (Prior Art). The body 200 of the pen 115X generally contains an ink accumulator and regulator 202 mechanism. The internal accumulator and regulator 202 has a fluidic coupling 204 for the off-axis ink reservoir 117X (FIG. 1 only). The printhead 206 element includes an appropriate electrical connector 208 (such as a tape automated bonding flex tape) for transmitting signals to and from the printhead. Columns of nozzles 210 form an addressable firing array 212. The typical state of the art scanning pen printhead may have two or more columns with more than one-hundred nozzles per column. In a thermal inkjet pen 115X, the drop generator mechanism includes a heater resistor subjacent each nozzle 210 which superheats locally chambered ink to a cavitation point such that an ink bubble's expansion and collapse ejects a droplet from the associated nozzle 210. In commercially available products, piezoelectric and wave generating element techniques are also used to fire the ink drops. Other ink-jet writing instruments are known in the art; some, for example, are structured as page-wide arrays. Degradation, or complete failure of the drop generator elements, cause drop volume variation, trajectory error, or misprints, referred to generically as "artifacts," and thus affect print quality.

Closed-loop ink-jet printing sensors enable a printer to monitor variable operational attributes and make appropriate adjustments automatically or to provide signals indicative of operational conditions to the end-user. One important attribute is ink level detection. In large format printers—such as for the printing of poster art—running out of ink in the middle of a print job is an inefficient and costly problem. Moreover, printing errors, also known as "artifacts," occur because of drop volume variation.

The most prevalent method of ink level sensing is to drop count. The print job data stream is provided into subsets for each of the primary colors. Therefore, tracking the number of times each nozzle is fired should theoretically account for ink consumption; the number of drops multiplied times the nominal drop volume subtracted from the fill level for each ink equals the volume of remaining ink. However, in fact, the drop volume may vary in absolute value by only one picoliter. With a nominal drop volume of approximately five picoliters in the state of the art, this is a relatively large percentage variation. Multiplied by the millions drops fired by a pen to create a single print swath, the error translates into large variations in the volume of ink consumed. Furthermore, the fill volume of each pen or reservoir also varies in accordance with manufacturing tolerance specifications.

One prior art solution is to have drop counters operate by firing each drop through a beam of light. A detector determines the percentage of the nozzles in which the ejected drop occludes the light beam. A decrease in the percent of nozzles which fire droplets blocking the light signifies the onset of an empty reservoir. However, the percent of missing nozzles can only be correlated to the ink remaining over the last few percentage of ink remaining. As drop volume decreases, both in design and due to reservoir depletion, more sophisticated optical interrupters must be employed to ensure accuracy, increasing manufacturing costs.

Another mechanism for ink level sensing is to provide a mechanical or fluidically controlled gauge on the print cartridge or reservoir. This requires regular monitoring by the end-user. Consequently, it is of less value than an automated system.

Another mechanism is to provide an electrical trigger which sends a signal to the end-user when the ink reaches a certain minimum level. These inductive sensors are a relatively expensive addition to the manufacturing cost of a simple ink supply tank.

There is a need for ink level sensing which is more accurate and less costly than state of the art modalities.

SUMMARY OF THE INVENTION

In its basic aspects, the present invention provides a method of determining remaining ink supply for an ink-jet printhead having a given ink supply volume. The method includes the steps of: determining an empirical relationship representative of printhead performance with respect to ink usage by percentage of number of prints printed and respective reflectance values; printing a test swath; optically scanning the test swath for determining an average reflectance level; and using said average reflectance level in said empirical relationship to determine the percentage of ink supply volume consumed.

In another basic aspect, the present invention provides a method of determining remaining ink supply for an ink-jet printhead having a given ink supply volume. The method includes the steps of: determining an empirical relationship representative of printhead performance with respect to ink usage by percentage of number of prints printed and respective reflectance values; printing a test swath; optically scanning the test swath for determining an average reflectance level; and using said average reflectance level in said empirical relationship to determine the percentage of ink supply volume consumed.

In another basic aspect the present invention provides a computerized routine for determining ink level depletion in an ink-jet ink supply. The computerized routine includes: programmable code means for expressing a predetermined relationship of printing reflectance level data to percentage of ink supply depletion; programmable code means for receiving reflectance level data based on a current print; and programmable code means for calculating percentage of ink supply depletion as a function of said relationship.

Some of the advantage of the present invention are:

- it operates physically independently of the ink supply itself;
- it can utilize existing multi-functional optical sensing equipment, therefore does not contribute to raising manufacturing costs;
- it is more accurate than known techniques for ink level detection;
- it can be used in conjunction with known manner techniques without requiring dedication to just ink level detection;
- it can be used in conjunction with drop counting to measure variation and consequently increase counting accuracy;
- it can be retrofit to existing hard copy apparatus designs or an installed base;
- it provides a means for both monitoring and notifying the end-user regarding ink consumption; and
- it operates independently of the writing instruments.

The foregoing summary and list of advantages is not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
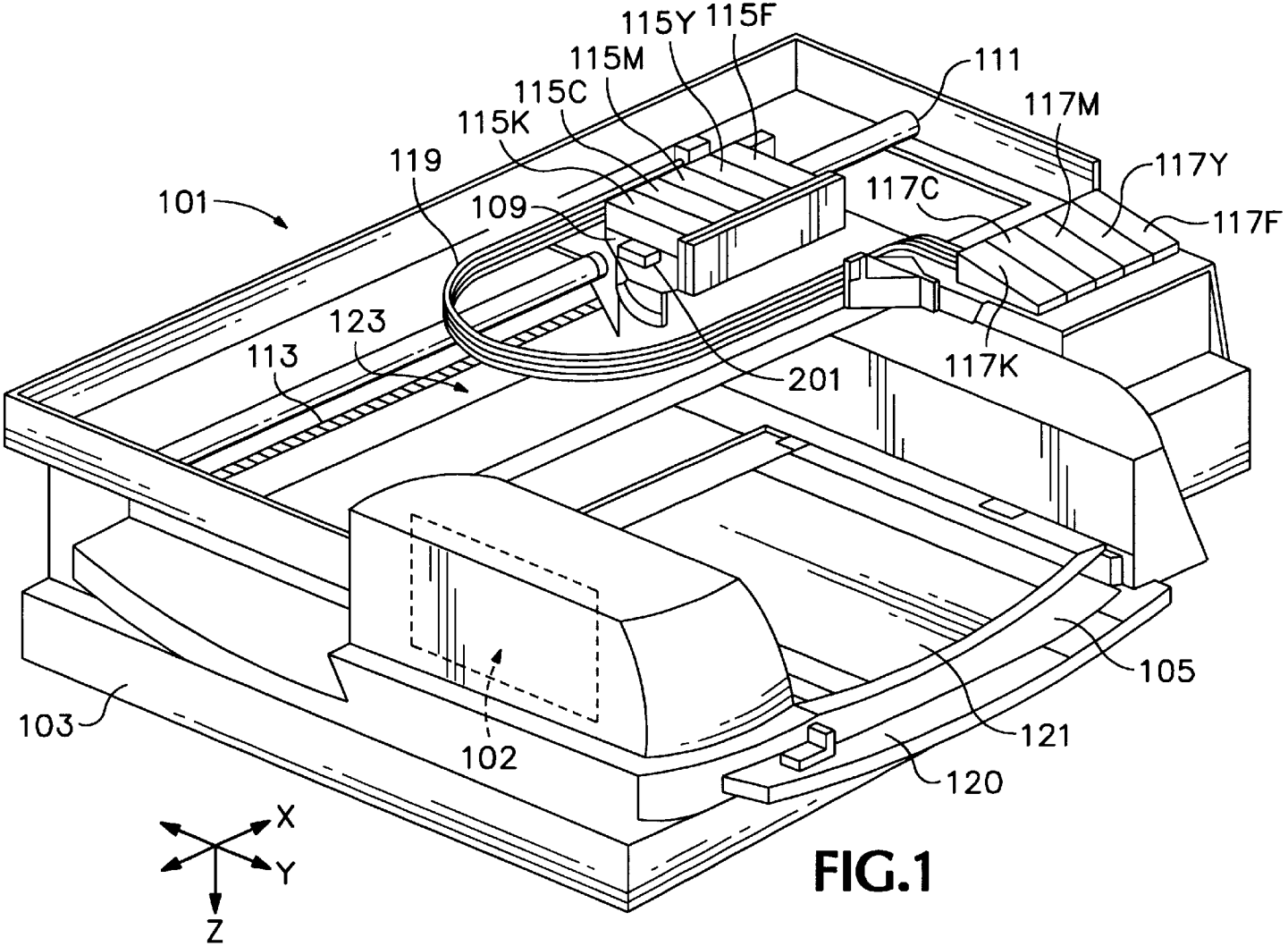
FIG. 1 is a perspective view schematic drawing of an ink-jet hard copy apparatus in accordance with the present invention.

The apparatus 101 as shown in FIG. 1 is provided with a multi-functional optical sensor 201 as will be described in more detail hereinafter with respect to FIGS. 3 and 8.

Figure 3:
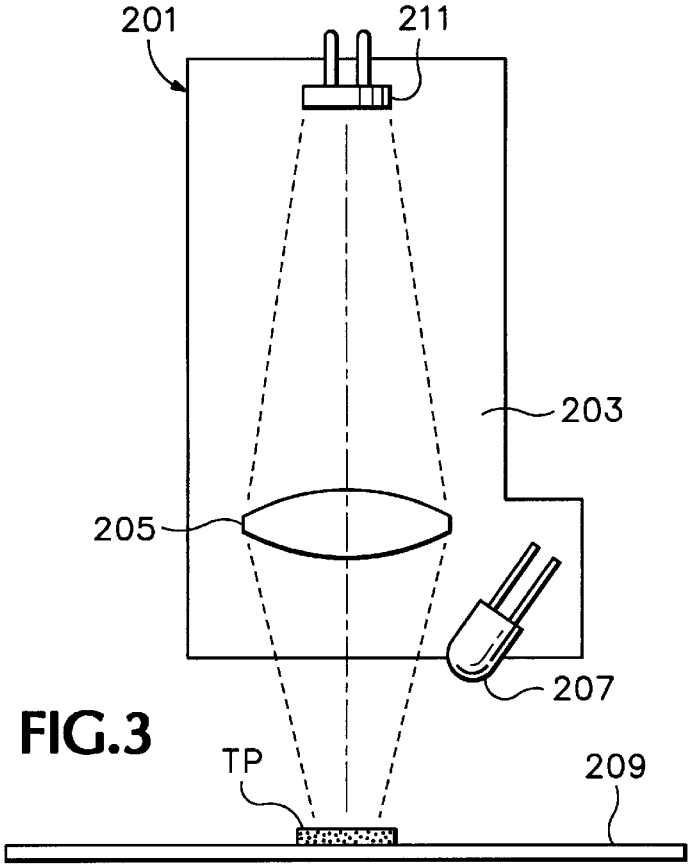
FIG. 3 is a schematic illustration of a simplified optical detector mechanism that can be employed in accordance with the present invention.

FIG. 3 is a schematic depiction of an exemplary optical sensor 201 that can be employed accordance with the present invention. Ink-jet nozzles of the printheads are generally in-line with the sensor module 201 in the x-axis by fixedly mounting the module 201 appropriately on the carriage 109 (FIG. 1). The sensor module 201 optically detects reflectivity values and provides electrical signals to the controller 102 and a controller based media alignment algorithm, described in detail hereinafter. An optical component holder 203 contains a lens 205. One or more light-emitting diodes ("LEDs") 207 are mounted to illuminate at an angle to the plane of the printing zone 123 (FIG. 1). The LEDs 207 project light (which can also be focused via a lens—not shown) onto the media or onto a printed test pattern "TP" printed with the printheads on the paper 209 and the light is then reflected to a photodetector 211. Known manner optical sensing and analog-to-digital ("A/D") signal process techniques are applied. For further details regarding a specific, multifunction, optical sensor module useful in accordance with the present invention, reference can be made to U.S. patent application Ser. No. 09/183,086 for a MONOCHROMATIC OPTICAL SENSING SYSTEM FOR INKJET PRINTING (filed Oct. 28, 1998 by Walker et al., common assignor herein) or U.S. Pat. No. 5,170,047 (Beauchamp et al.) for an OPTICAL SENSOR FOR PLOTTER PEN VERIFICATION (both assigned to the common assignee of the present invention and incorporated herein by reference).

Figure 2:
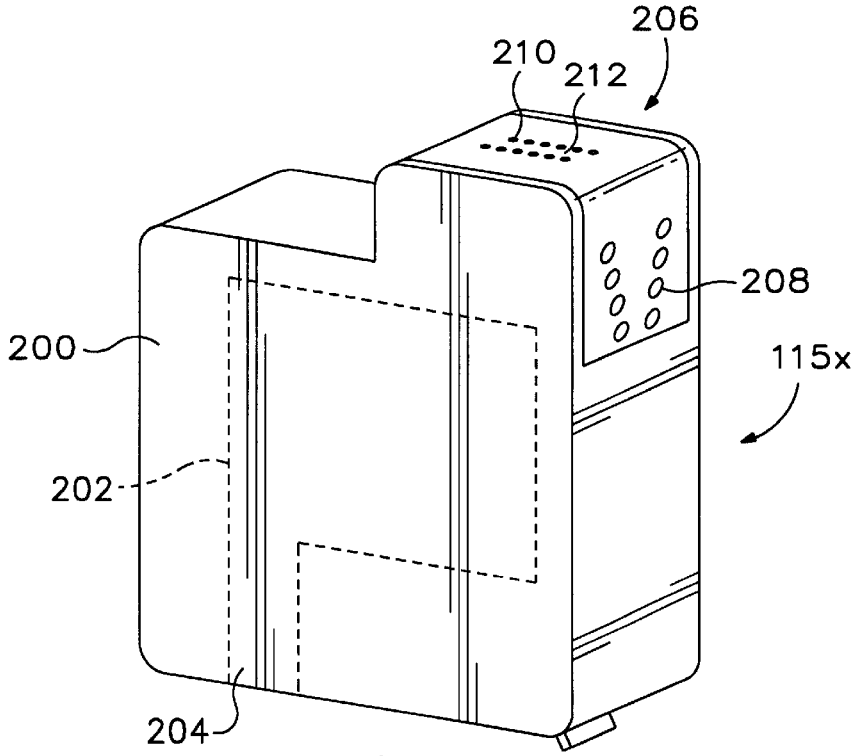
FIG. 2 (Prior Art) is a schematic drawing in perspective view of an inkjet writing instrument.

The present invention is for a media-based optical ink level sensing method and apparatus. Referring to FIGS. 1 and 2, as a pen 115X, or its on-board ink accumulation chamber, is depleted of ink due to an empty reservoir 117X, the back-pressure regulator mechanism 202 transitions to remaining fully open as it is being starved of its ink supply. This has an effect of reducing the volume of ejected ink drops. As each individual nozzle 210 has a manifold ink channel for delivering ink to its subjacent drop generator ink chamber, with a diminishing ink level, the ability of each drop generator to draw ink into its chamber is diminished. Nozzles 210 can be starved of ink and randomly begin to fail to fire. It has been found that the effects of the volume reduction become apparent during approximately the last 15% of the pen's life.

In accordance with the present invention, optical reflectance of a full-bleed (saturation printing by dotting every pixel of the paper at full resolution, e.g., 600 dots per inch ("DPI")) test pattern element is measured at the beginning of a pen's life and stored in memory, e.g., a pen set look-up table ("LUT"), as the "full" reflectance characteristic of that particular pen. Whenever a pen is removed or replaced, a calibration page can be printed automatically and readings taken from elements of that test pattern for each pen. The DC (static or non-moving) reflectance level of the paper used for the calibration page is also stored.

Figure 4:
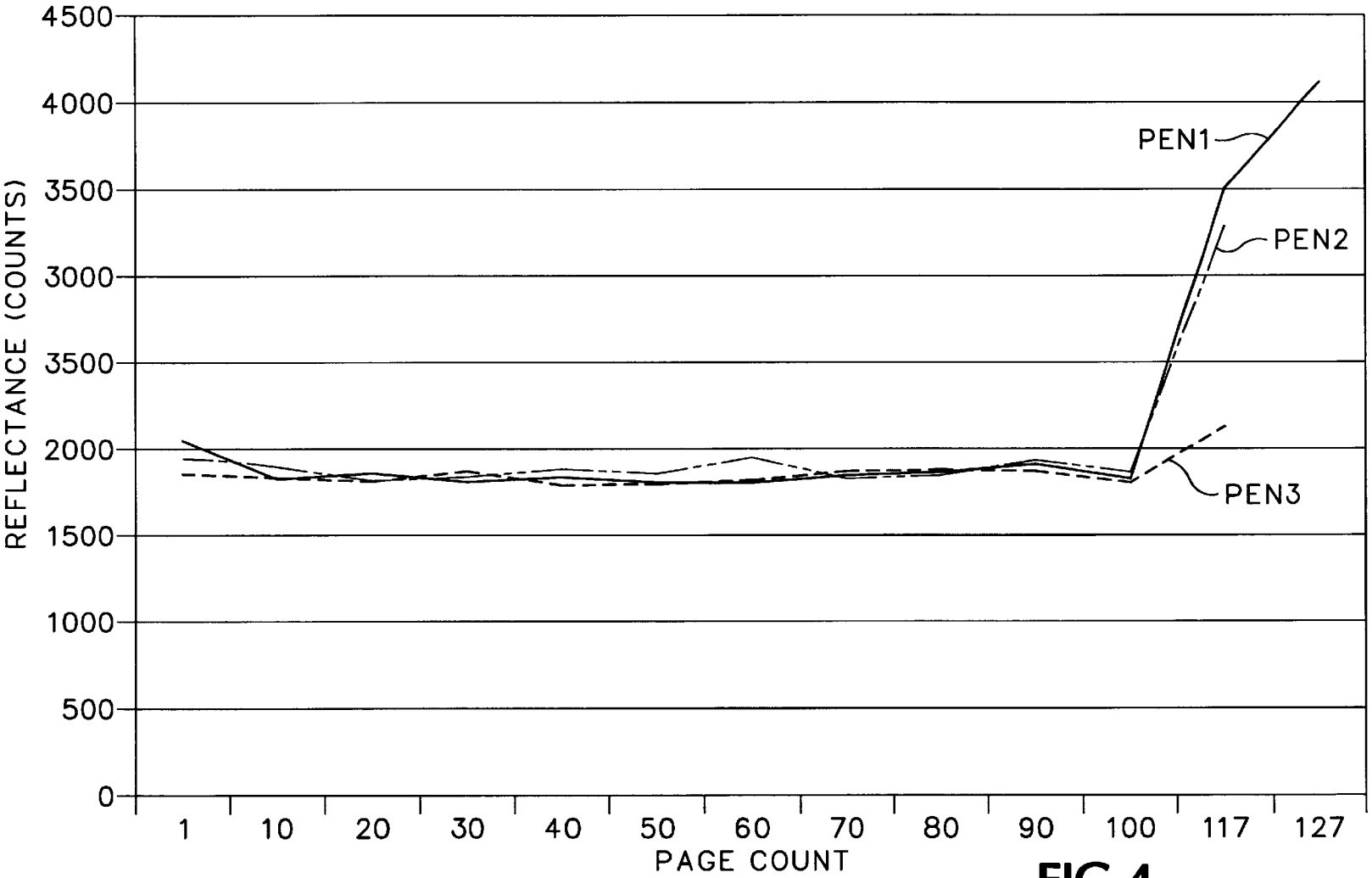
FIG. 4 is a graph showing ink-jet print reflectance values versus page count over the life of several exemplary ink-jet writing instruments.

FIG. 4 is a typical plot of reflectance recorded by an optical detector over the life of a pen having a given volume reservoir, performing a full page length printing of each page. Recorded reflectance is fairly constant up until a last fraction of pen life.

Figure 5:
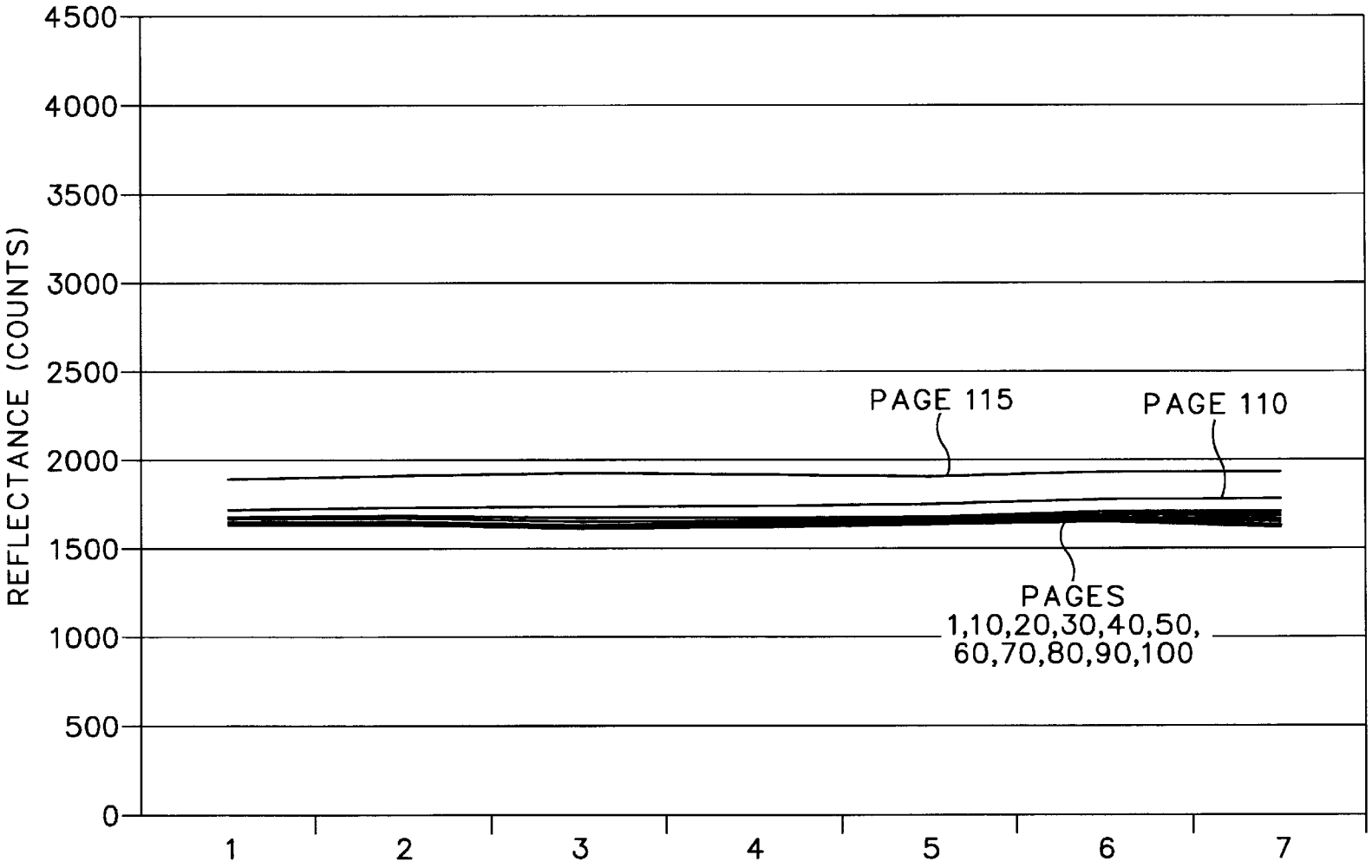
FIG. 5 is a graph showing ink-jet print reflectance values changing over a scan as several exemplary ink-jet writing instruments are starved of supply ink.

FIG. 5 demonstrates another factor. As a printhead begins to starve, at the beginning of a swath, it may perform adequately, but by the end of the swath printing errors occur and in fact some nozzles may begin to totally misfire. A definite slope in the reflectance data emerges as an indication of the failing performance level.

Figure 6:
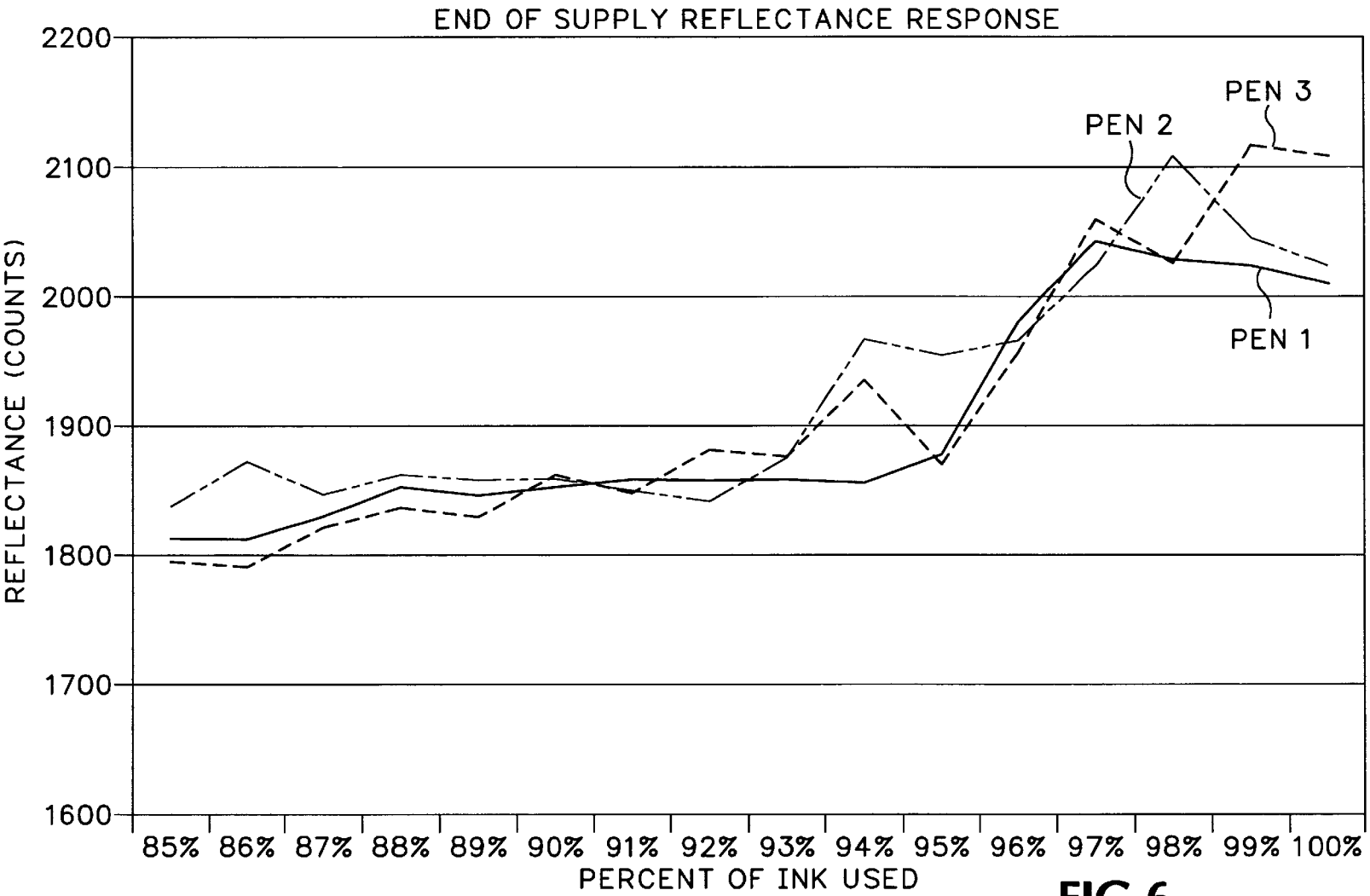
FIG. 6 is a graph showing ink-jet print reflectance values versus percentage of ink used after consumption of at least about 85% of the ink supply for several exemplary ink-jet writing instruments.
Figure 7:
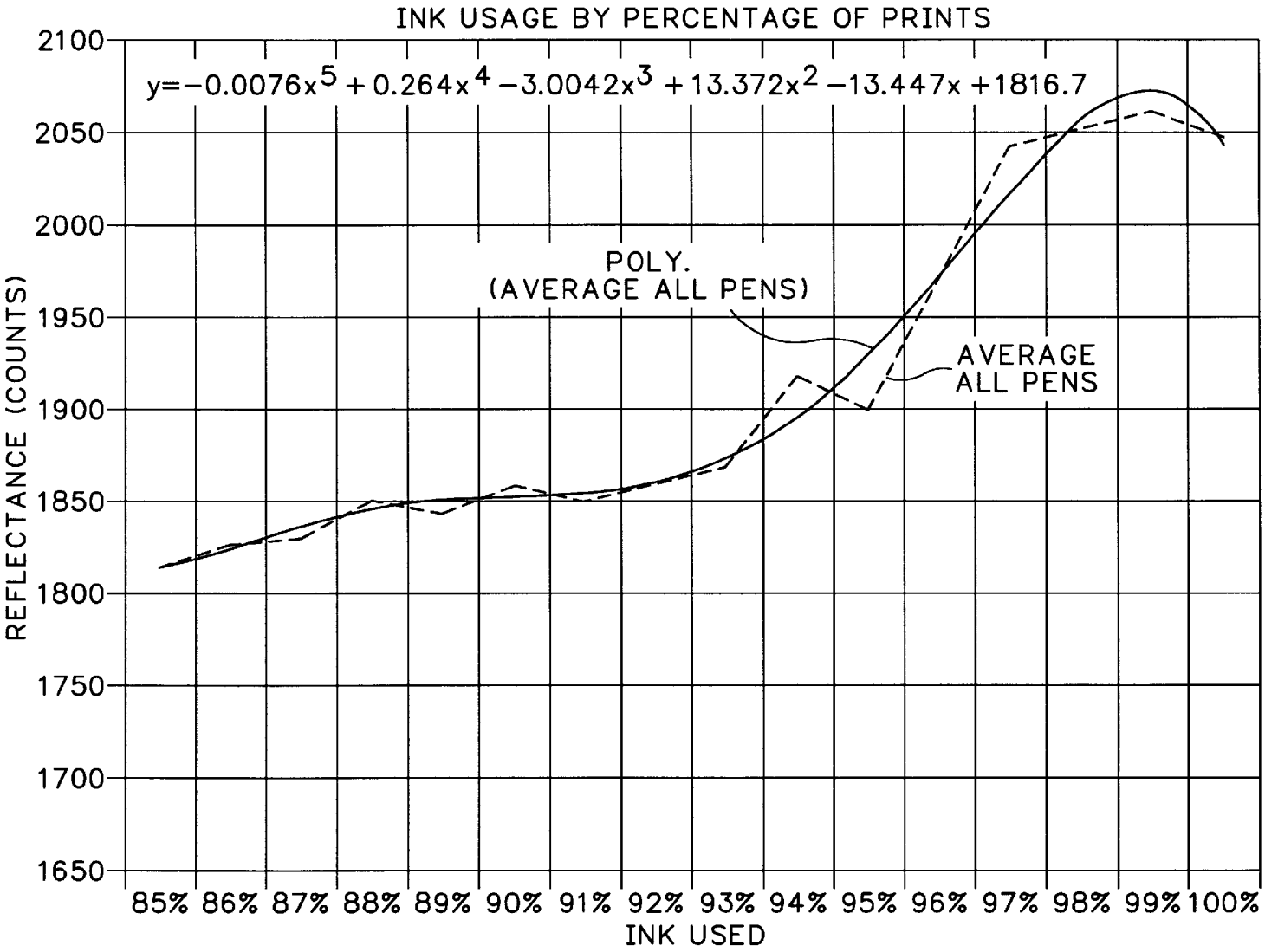
FIG. 7 is a graph showing a derived polynomial equation fit to a plot of reflectance values versus percentage of ink supply used.

The number of pages can be correlated to the percentage of ink used. In order to develop a useful correlation, printing a uniform number of drops on each test page is performed. FIG. 6 is a plot of the last 15% of the ink consumed against the reflectance at the lower right edge of the test page, the location of greatest signal. An equation can be formulated to express coefficients normalized to a DC value. Actual coefficients for a given pen and print media type can be calculated knowing the full reflectance value and the reflectance value for the blank media as initially obtained during the new pen calibration plot. The shape of the curve can accurately approximated by a fourth-order or higher polynomial equation. A fifth-order exemplary polynomial best fit for FIG. 7 is:

$$y=-0.0076x^5+0.264x^4-3.0042x^3+13.372x^2-13.447x+1816.7 \quad \text{(Equation 1)},$$

where "x" is percent ink consumed and "y" is reflectance.

Generically, the curve can be expressed as:

$$y=A+Bx+Cx^2+Dx^3+Ex^4 \text{ [et seq.]} \quad \text{(Equation 2)},$$

where A et seq. are coefficients for each of the orders of x, and where, to further the example, A is between zero and 4096, B is between −1000 and +1000, C is between −1000 and +1000, D is between −100 and +100, E et seq. is between −10 and +10, for a twelve-bit analog-to-digital converter.

In FIG. 7, Equation 1 curve is shown as fit to the average of the data from three pens of a test bed printer. By looking at the magnitude of the coefficients, it can be seen that for small values of x—that is, the ink consumed is negligible—the coefficient "A" dominates the predicted reflectance value. Coefficient A has the effect of shifting the entire response curve up or down for all levels of ink consumption. Thus coefficient A is the "zero-order," or DC value of the expression. Likewise, it can be seen that as x increases, the coefficients of the higher order terms have an increasingly greater influence on the value of the reflectivity. For example, at 100% ink depletion, the $4^{th}$ and higher order magnitude terms evaluate to a magnitude of$^{123}$ while the DC term has a magnitude of only $10^3$. For any given level of ink consumption, the reflectance value measured will depend on the color of the ink, the amount of ink that the printer is trying to place within a given area on the paper (saturation), and the reflectivity of the paper surface. When a sampling of ink consumption is performed, the color of the ink ejected from the pen under test is known. Likewise, the ink volume per area commanded by the printer is also known. The only unknown is the reflectivity. To compensate (normalize) for paper reflectance values, a reference reflectance is need at a known level of ink consumption. The reference is obtained by measuring the reflectance as if the supply was empty (100% ink consumption); this corresponds to blank paper surface reflectance. The 100% ink consumption reflectance can therefore be taken regardless of the actual level of ink consumed. When the coefficients are determined, the paper used for all characterization can be standardized; for this example, Gilbert Bond (TM) from Mead Paper, Magnesia Wis.) was used. The reflectance value for plain paper, and thus a value representative of 100% ink consumed, is 2040 as shown in FIG. 7. In the best mode, for a particular printer-sensor combination, the current required to drive the optical sensor's light projector device is varied until the measured reflectance from the test paper equals 2040 counts. The current to obtain 2040 counts is recorded as "$_{IC}$." Likewise during testing, the unknown, unprinted paper reflectance is measured and the current to obtain 2040 counts is recorded as "$i_S$." The intensity of an LED projector varies with the current by a known relationship, for example:

$$I=100i \quad \text{(Equation 3)},$$

where "I" is intensity in units of millicandela and the current "i" is in units of milliamperes. In general, this can be expressed:

$$I=f(i) \quad \text{(Equation 4)}.$$

To normalize the reflectance for an unknown paper used, the intensity for the characterized media is determined as:

$$I_C=f(i_C) \quad \text{(Equation 5),}$$

while the intensity for the unknown paper is determined as:

$$I_S=f(i_S) \quad \text{(Equation 6).}$$

The test is performed and the printed reflectance value is measured as Ym. The compensated reflectance value is then calculated as:

$$Yc=(Ym)(I_S \div I_C) \quad \text{(Equation 7).}$$

The ink consumed is calculated iteratively by inserting estimates if the percent ink consumed into Equation 1 (or 2) and calculating the corresponding characterized reflectance Y. Only relevant positive values of ink consumed are considered. The result is compared to Yc and a corresponding higher or lower value of x until Y=Yc. Thus, the variation between media is compensated as well as variation in the optical sensor device response.

Figure 8:
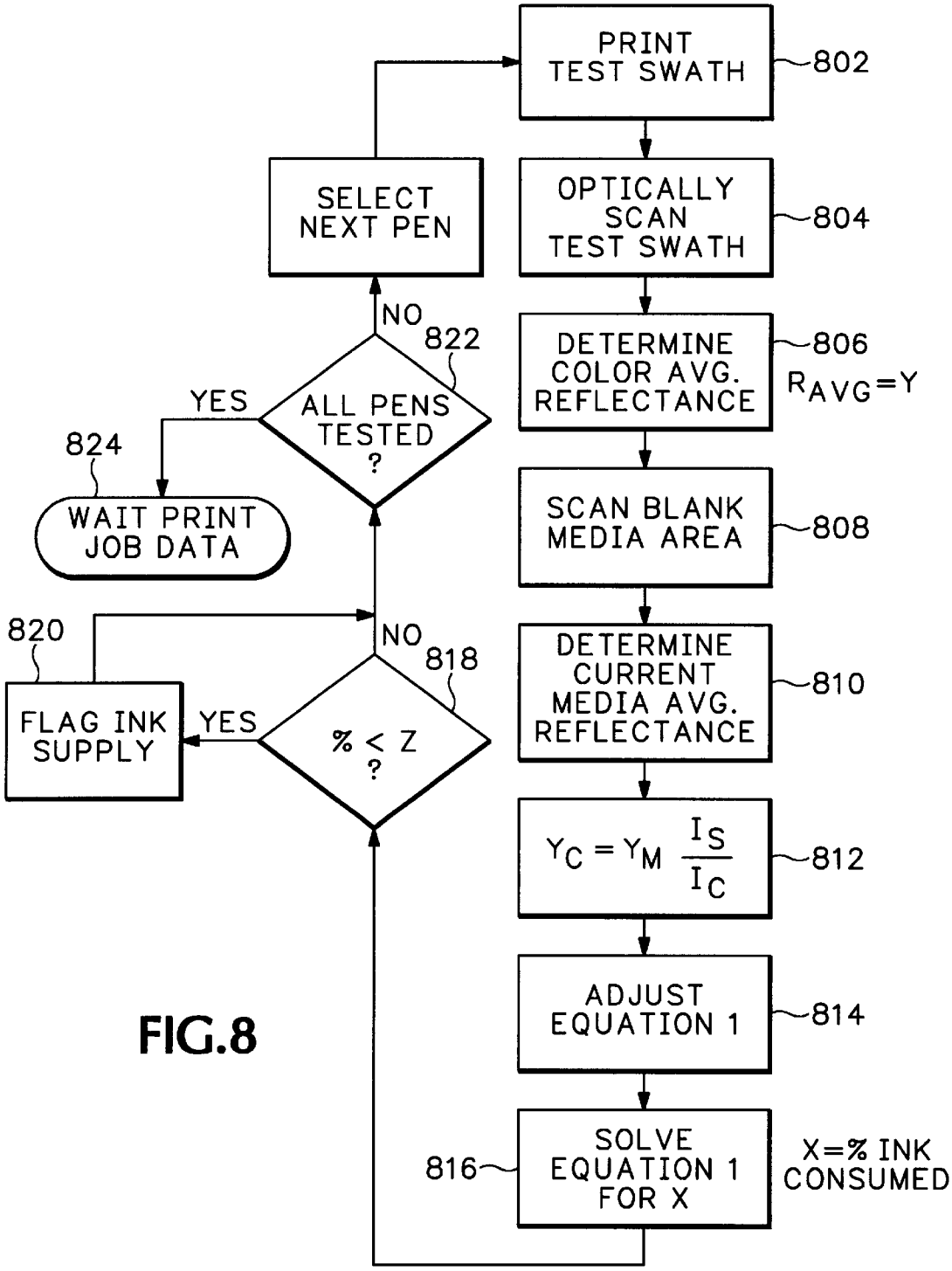
FIG. 8 is a flow chart of operation of the present invention as implemented for a hard copy apparatus as depicted in FIG. 1.

Turning now to FIG. 8, in accordance with the present invention, whenever an opportunity to determine remaining pen life occurs—e.g., prior to starting a print job when ink remaining in a pen is unknown—a full-bleed test swath of the color is printed, step 802. The swath is printed having a length suitable to provide data which may have a slope if the pen is low on ink. The test swath is optically scanned, step 804. An average of the reflectance data is calculated, step 806. An non-printed paper region is scanned, step 808, and an average calculated, step 810. The ratio of the original non-printed paper reflectance measured during initial calibration, "$M_1R$," to the non-printed average just taken, "$M_2R$," is determined, step 812, and used to adjust the coefficients of the polynomial, step 814. The measured reflectance average is inserted for "y" in Equation 1 and the value for "x" is solved iteratively, step 816. The returned value of "x" is the percentage of ink consumed. If the percentage of ink consumed is less than some predetermined level, "z," needed for successful printing, step 818, YES-path, the need for a new ink supply is indicated, step 820. The process is repeated, step 822, for each colorant supply. The apparatus is then ready for a next print job, step 824. The "z" factor can be empirically determined based on the printer design and its customary print job requirements. For example, a large format plotter for poster art may need a larger remaining percentage of ink than a desktop text printer for a typical next print job.

As will be recognized by those skilled in the art, the process inherent in the present invention can be implemented in software or firmware programmable code compatible with known manner controller devices 102.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . ."

What is claimed is:

1. A method of determining remaining ink supply for an ink-jet printhead having a given ink supply volume, comprising the steps of:

determining an empirical relationship representative of printhead performance with respect to ink usage by percentage of number of prints printed and respective reflectance values;

printing a test swath;

optically scanning the test swath for determining an average reflectance level; and using said average reflectance level in said empirical relationship to determine the percentage of ink supply volume consumed.

2. The method as set forth in claim 1, comprising the step of:

adjusting said empirical relationship for changes in reflectance levels associated with different subjacent printing media reflectance characteristics.

3. The method as set forth in claim 1, comprising the step of:

said relationship is defined by a multi-order polynomial equation relating a real-time media reflectance value to ink consumption.

4. The method as set forth in claim 1, comprising the step of:

said relationship is defined by the equation, $$y=A+Bx+Cx^2+Dx^3+Ex^4 \ldots Nx^n.,$$

where y is a determined average reflectance level, and x is solved for, providing a percentage of ink supply consumed, wherein A, B, C, D, E, . . . N are all integers.

5. The method as set forth in claim 4, comprising:

A is between zero and 4096,

B is between −1000 and +1000,

C is between −1000 and +1000,

D is between −100 and +100,

E et seq. is between −10 and +10, for a system employing a twelve-bit analog-to-digital converter.

6. An apparatus for determining remaining ink supply for an ink-jet printhead having a given ink supply volume, comprising:

means for determining an empirical relationship representative of printhead performance with respect to ink usage by percentage of number of prints printed and respective reflectance values;

means for printing a test swath;

means for optically scanning the test swath for determining an average reflectance level; and means for using said average reflectance level in said empirical relationship to determine the percentage of ink supply volume consumed.

7. The apparatus as set forth in claim 6, the means for printing and determining further comprising:

means for adjusting an empirical relationship indicative of changes in reflectance levels associated with different subjacent printing media reflectance characteristics.

8. The apparatus as set forth in claim 7, comprising:

said relationship is defined by a multi-order polynomial equation relating a real-time media reflectance value to ink consumption.

9. The apparatus as set forth in claim 7, comprising:

said relationship is defined by the equation, $$y=A+Bx+Cx^2+Dx^3+Ex^4 \ldots Nx^n,$$

where y is a determined average reflectance level, and x is solved for, providing a percentage of ink supply consumed, wherein A, B, C, D, E . . . N are all integers.

10. The apparatus as set forth in claim 9, comprising:

A is between zero and 4096,

B is between −1000 and +1000,

C is between −1000 and +1000,

D is between −100 and +100,

E et seq. is between −10 and +10, for a system employing a twelve-bit analog-to-digital converter for determining real-time reflectance levels.

11. A computer program, embodied on a computer readable medium, for determining ink level depletion in an ink-jet supply, for a system employing an ink-jet printer having produced a current print using an available ink supply comprising:

programmable code means for expressing a predetermined relationship of printing reflectance level data to percentage of ink supply depletion;

programmable code means for receiving reflectance level data based on a current print and for generating a value representative thereof; and programmable code means using said value for calculating current percentage of ink supply depletion as a function of said relationship.

12. The invention as set forth in claim 11, comprising:

said programmable code means for receiving including means for adjusting said predetermined relationship for changes in reflectance levels associated with different subjacent printing media reflectance characteristics.

13. The invention as set forth in claim 11, wherein said predetermined relationship is defined by a multi-order polynomial equation relating a real-time media reflectance value to ink consumption.

14. The invention as set forth in claim 13, wherein said relationship is defined by the equation, $$y=A+Bx+CX^2+Dx^3+Ex^4 \ldots Nx^n,$$

where n is the highest order of polynomial factor employed in said relationship, y is a determined average reflectance level, and x is solved for, providing a percentage of ink supply consumed, wherein A, B, C, D, E, . . . N are all integers.

15. The invention as set forth in claim 14, wherein A is between zero and 4096, B is between −1000 and +1000, C is between −1000 and +1000, D is between −100 and +100, and E is between −10 and +10, for a system employing a twelve-bit analog-to-digital converter for determining current media reflectance levels.

* * * * *

UNITED STATES PATENT AND TRADEMARK OFFICE

CERTIFICATE OF CORRECTION

PATENT NO. : 6,312,075 B1
DATED : November 6, 2001
INVENTOR(S) : Walker

It is certified that error appears in the above-identified patent and that said Letters Patent is hereby corrected as shown below:

Column 8,
Line 38, delete "$y=A+Bx+Cx^2+Dx^3+Ex^4 \ldots NX^n$.," and insert therefor
-- $y=A+Bx+Cx^2+Dx^3+Ex^4 \ldots Nx^n$, --.

Column 10,
Line 28, after "-10 and +10," insert -- and N=0 --

Signed and Sealed this

Fifth Day of August, 2003

JAMES E. ROGAN
*Director of the United States Patent and Trademark Office*